US010413033B1

(12) United States Patent
Silva

(10) Patent No.: US 10,413,033 B1
(45) Date of Patent: Sep. 17, 2019

(54) PONYTAIL PLUG

(71) Applicant: David Silva, Reno, NV (US)

(72) Inventor: David Silva, Reno, NV (US)

( * ) Notice: Subject to any disclaimer, the term of this patent is extended or adjusted under 35 U.S.C. 154(b) by 202 days.

(21) Appl. No.: 15/275,012

(22) Filed: Sep. 23, 2016

(51) Int. Cl.
*A45D 8/00* (2006.01)
*A45D 8/34* (2006.01)

(52) U.S. Cl.
CPC ..... *A45D 8/34* (2013.01); *A45D 8/00* (2013.01); *A45D 2008/004* (2013.01)

(58) Field of Classification Search
CPC ... A45D 8/38; A45D 8/34; A45D 8/20; A45D 8/00; A45D 2008/004
USPC ..... 132/107, 274, 273, 276, 277
See application file for complete search history.

(56) References Cited

U.S. PATENT DOCUMENTS 566,779 A * 9/1896 Liebreich ..... A45D 8/12 132/106
731,575 A * 6/1903 Johnston ..... A45D 8/12 132/106
741,870 A * 10/1903 Wood ..... A45D 8/38 132/55
5,573,017 A * 11/1996 Post ..... A44C 15/0015 132/275
7,004,179 B1 * 2/2006 Lunde ..... A45D 8/12 132/273
2009/0114241 A1 * 5/2009 Tu ..... A45D 8/20 132/277
2012/0048291 A1 * 3/2012 Chudzik ..... A45D 8/14 132/276
2016/0270502 A1 * 9/2016 Keenan ..... A45D 8/00
2017/0367454 A1 * 12/2017 Collier ..... A45D 8/12
2018/0132554 A1 * 5/2018 Minami ..... A42B 1/062
2018/0343997 A1 * 12/2018 Grant ..... A45D 8/34

* cited by examiner

*Primary Examiner* — Tatiana L Nobrega

(57) ABSTRACT

A hairstyling tool for attaching various hair articles to a banded ponytail by inserting a bead that is attached to a hair article, through a banded ponytail center axis. The very center axis of a banded ponytail has a lot of tension. If a bead, or similar tapered device, is pushed through the banded ponytail center axis, toward a person's scalp, it locks into place. If a hair article is attached to an end of the bead, the hair article stays secured to the ponytail.

6 Claims, 2 Drawing Sheets

PONYTAIL PLUG

BACKGROUND OF THE INVENTION

1. Field of the Invention

The present invention and method relates to a hair styling device. More particularly, to various hair accessories that are attached to a ponytail center axis.

2. Description of Prior Art

Many people like to style their hair. There are several hair accessories, but never an accessory that plugs into the center axis of a ponytail, between the hair band and the users scalp, stays in place, and can easily be pulled out after use.

SUMMARY OF THE PRESENT INVENTION

An object of the present invention is to provide an instrument that is convenient, practical, and inexpensive for use in hair styling.

A further object is to provide an instrument that will easily hold a hair styling article in place in the center of a ponytail and is easily removable.

A further object is to provide such an instrument that can be used unassisted by the individual styling their hair, eliminating the expense of a professional stylist.

A further object is to provide an instrument that can be reused over and over again.

A further object is to provide an instrument that will quickly style and hold the user's hair in a neatly secured position.

According to the present invention, I discovered that the very center axis of a banded ponytail has a lot of tension on anything that is inserted into it. If a small, tapered device, such as a plug, bead, or similar means, is pushed through the banded ponytail center axis, toward the person's scalp, it locks in place on the other side of the hair-band. If a hair article is attached to an end of the tapered device, the hair article stays secured to the ponytail. According to the arrangement described above, the various hair articles could be:

1. Curved prongs protruding out from a bead center. This would be plugged into the ponytail center and the prongs would slightly stick out of the ponytail to fan the ponytail out. The prongs could have decorations on it such as rhinestones, or fake flowers. Once inserted in the ponytail, the ponytail could also be wrapped around the prongs and tucked into them to create a bun or chignon.
2. A wire attached to a bead, wherein the bead is locked into place, as described, into the center of the ponytail. This makes it possible for the wire to travel along the length of the ponytail, which can then be wrapped and bent into various hairstyles. The wire could also be covered with decorative fabric.
3. The bead could be attached to a piece of somewhat wide plastic. Whereby, the plastic would stick out from the ponytail center making some of the ponytail hair fan out over its top, giving the user the appearance of a thicker looking ponytail. The top could have some sort of no slip material such as the hook part of Velcro, or a rubber coating to help keep the hair on its top. The wide piece of fabric could be arched so the ponytail fans out and curves slightly.
4. The bead could be attached to an elongated piece of decorative fabric, or several elongated pieces of decorative fabric. The fabric could then be tied around the ponytail, wrapped around the ponytail, or braided with the ponytail.
5. The bead could be attached to a swatch of elongated hair. The swatch could be longer than the user's ponytail, so when the bead is plugged into the ponytail center the hair swatch will travel downward along the ponytail inside making it look thicker and then past the user's ponytail open end, giving it the appearance of a longer, thicker ponytail. After it is attached, the entire ponytail could be wrapped into an extra thick bun, chignon, or similar style.
6. The bead could be attached to the inside of a hollowed half dome shape, or hair-net, wherein the bead can be plugged into the center of the ponytail and the ponytail can be inserted inside the hollowed space of the dome, or hair-net to hold the hair in a covered bun style.

Accordingly a preferred embodiment, the tapered device is a bead. However, the bead that is inserted into the ponytail center axis can be anything that is tapered at its tip so it can be easily inserted into the ponytail center, past the ponytail band toward the scalp, until it is locked in place. Since it is tapered at tip, then wider at middle, it locks in place once past the band. The bead or similar tapered device is preferably tapered again at the opposite end, where it is attached to the hair article, so it can be pulled on to easily pop back out of the ponytail after use. Other objects, features and advantages of the present invention will become apparent from the following description of the preferred embodiments given with reference to the accompanying drawings.

BRIEF DESCRIPTION OF THE DRAWINGS

In the accompanying drawings

DETAILED DESCRIPTION OF THE INVENTION

Figure 1:
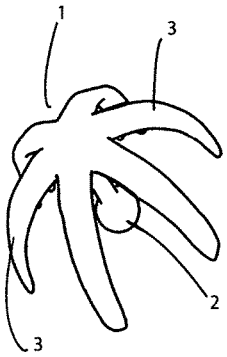
FIG. 1 is a perspective view of the curved prong version.
Figure 2:
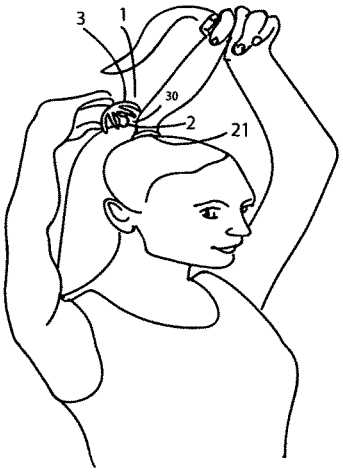
FIG. 2 through 5 is a schematic view of the curved prongs version. It shows how the bead is inserted for all the embodiments.
Figure 3:
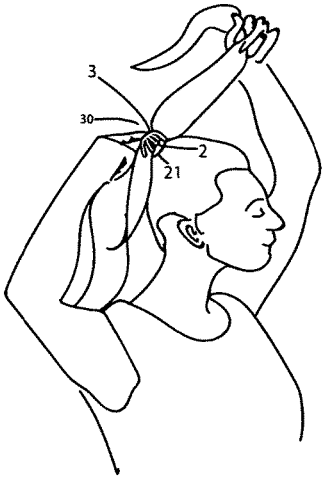
Figure 4:
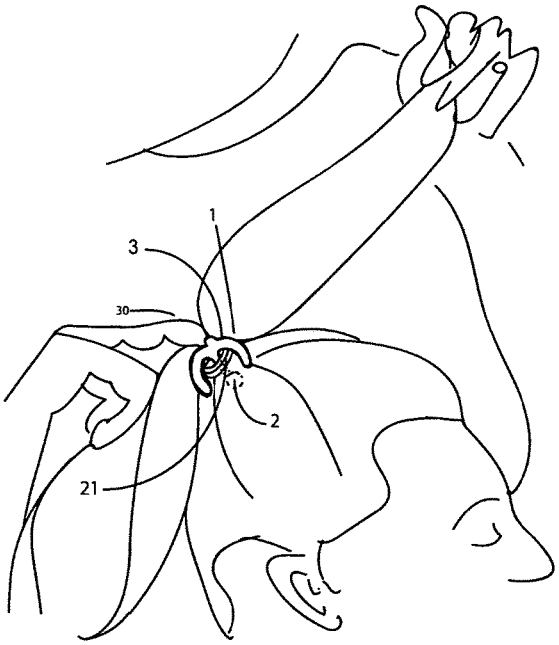
Figure 5:
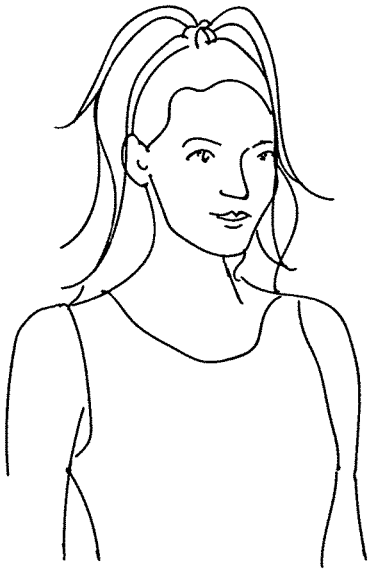

Referring to FIG. 1 of the accompanying drawings, there is a curved prong device, generally designated by reference numeral 1, embodying the present invention. The curved prong device 1 comprises a first bead 2 and a plurality of curved prongs 3. In use FIG. 2 through FIG. 5 the bead 2 is inserted into the ponytail center axis 30 toward the users head, past the ponytail band 21 until locked in place.

Figure 6:
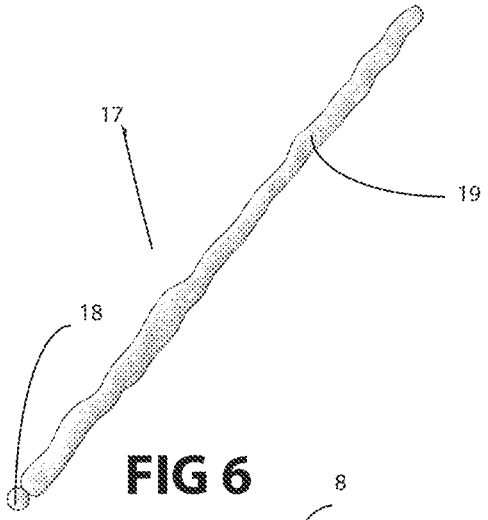
FIG. 6 is a perspective view of the wire version.

FIG. 6 of the accompanying drawings is a wire version generally designated by reference numeral 17, embodying the present invention. The wire version 17 comprises a first bead 18 and an elongated covered wire 19.

Figure 7:
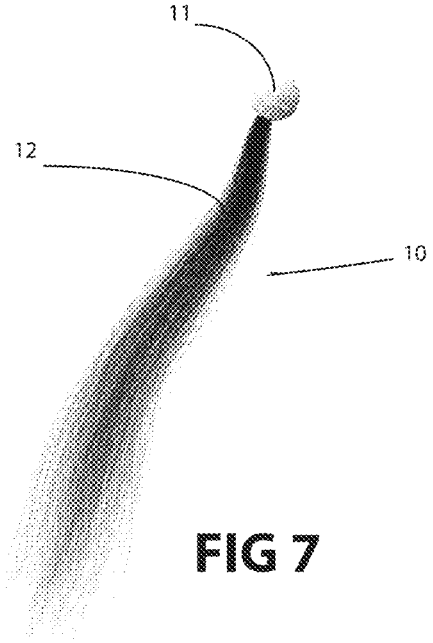
FIG. 7 is a perspective view of the hair swatch version.

FIG. 7 of the accompanying drawings, there is a hair swatch version, generally designated by reference numeral 10, embodying the present invention. The hair swatch version 10 comprises a first bead 11 and an elongated swatch of hair 12.

Figure 8:
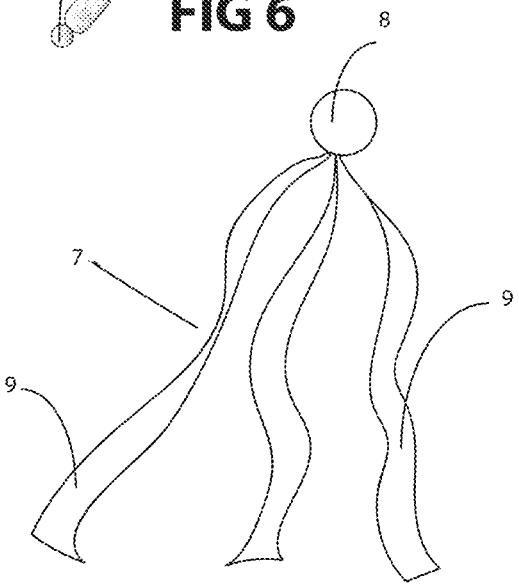
FIG. 8 is a perspective view of the decorative fabric version.

FIG. 8 of the accompanying drawings, there is a decorative fabric version, generally designated by reference numeral 7, embodying the present invention. The version 7 comprises a first bead 8 and at least one elongated length of fabric 9.

Figure 9:
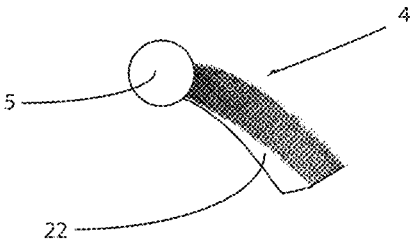
FIG. 9 is a perspective view of the wide curved member version.

FIG. 9 of the accompanying drawings is a wide curved version, generally designated by reference numeral 4, embodying the present invention. The wide curved version 4 comprises a first bead 5 attached to a wide curved member 6. No-slip material 22 is on the top of the curved member to keep hair from sliding off.

The present invention being thus described, the same may be varied in many ways by using the bead attached to other various hair articles obvious in the art. Further, any way to use the present invention obvious in the art should apply.

I claim:

1. A ponytail plug for insertion in hairs gathered in a ponytail, the ponytail plug comprising:

a spherical bead having a diameter and forming a proximal portion of the ponytail plug;

an elongated shaft extending from a distal end of the spherical bead where the elongated shaft and spherical bead define a longitudinal axis of the ponytail plug, the elongated shaft having a substantially uniform width defined along a direction perpendicular to the longitudinal axis, where the width of the elongated shaft is smaller than the diameter of the spherical bead a plurality of curved prongs integrally extending from a central portion coupled to a distal end of the elongated shaft, wherein the central portion defines a distal-most terminal end of the ponytail plug and the plurality of curved prongs and central portion form a convex outer surface, the plurality of curved prongs extend radially outwardly and downwardly in a proximal direction toward the spherical bead such that a terminal end of each prong is disposed proximate and spaced radially from the spherical bead;

wherein during use, the spherical ball is inserted through a center axis of a banded ponytail of hair on a user's head and the plurality of curved prongs fan out the hair.

2. The ponytail plug of claim 1 above, further comprising decorations disposed on the plurality of prongs.

3. The ponytail plug of claim 2 above, wherein the decorations are rhinestones or fake flowers.

4. A method of securing a ponytail plug to a ponytail, the method comprising:

providing the ponytail plug of claim 1;

gathering a user's hair and securing a band around the gathered hair to form the ponytail;

inserting the spherical bead through a central axis of the ponytail toward the user's head and past the band of the ponytail until locked in place.

5. The method of claim 4 above, wherein after the inserting step, the prongs stick out of the ponytail slightly to fan out the hair of the ponytail.

6. The method of claim 4 above, wherein after the inserting step, the hair of the ponytail is wrapped around the prongs and tucked under the prongs to create a bun or chignon.

* * * * *